US009495856B2

(12) United States Patent
Brenner

(10) Patent No.: US 9,495,856 B2
(45) Date of Patent: Nov. 15, 2016

(54) PROTECTION DEVICE

(76) Inventor: Rainer Brenner, Teningen-Kondringen (DE)

( * ) Notice: Subject to any disclaimer, the term of this patent is extended or adjusted under 35 U.S.C. 154(b) by 0 days.

(21) Appl. No.: 14/000,752

(22) PCT Filed: Feb. 21, 2012

(86) PCT No.: PCT/EP2012/000749
§ 371 (c)(1),
(2), (4) Date: Aug. 21, 2013

(87) PCT Pub. No.: WO2012/113536
PCT Pub. Date: Aug. 30, 2012

(65) Prior Publication Data
US 2013/0321163 A1 Dec. 5, 2013

(30) Foreign Application Priority Data
Feb. 23, 2011 (DE) ..... 10 2011 012 163

(51) Int. Cl.
*G08B 21/00* (2006.01)
*G08B 21/18* (2006.01)
*G08B 13/14* (2006.01)

(52) U.S. Cl.
CPC ..... *G08B 21/182* (2013.01); *G08B 13/1436* (2013.01); *G08B 13/1481* (2013.01)

(58) Field of Classification Search
CPC ..... G08B 13/1436; G08B 13/1481
USPC ..... 340/686.6, 571, 568.1, 568.2
See application file for complete search history.

(56) References Cited

U.S. PATENT DOCUMENTS

| | | | | |
|---|---|---|---|---|
| 5,068,643 | A | 11/1991 | Yashina | |
| 6,069,560 | A * | 5/2000 | Larsson | 340/683 |
| 6,590,497 | B2 * | 7/2003 | Chandar | 340/571 |
| 7,336,182 | B1 | 2/2008 | Baranowski et al. | |
| 7,474,215 | B2 * | 1/2009 | Scott et al. | 340/568.1 |
| 7,557,700 | B2 | 7/2009 | Gresset et al. | |

FOREIGN PATENT DOCUMENTS

| | | | |
|---|---|---|---|
| DE | 102008009491 | A1 | 8/2009 |
| GB | 2 367 173 | A | 3/2002 |

* cited by examiner

*Primary Examiner* — John A Tweel, Jr.
(74) *Attorney, Agent, or Firm* — Nath, Goldberg & Meyer; Jerald L. Meyer

(57) ABSTRACT

The invention relates to a device for securing objects against unauthorized removal. To this aim, the device (26) comprises an alarm electronics unit (1) having a motion sensor (3), an environmental brightness sensor (4), and an alarm signal transmitter (5). The alarm electronics unit (1) is designed so that the ambient brightness sensor (4) is activated by the detection of a movement. However, alarm release occurs only if the ambient brightness measured at the ambient brightness sensor (4) exceeds a predetermined brightness threshold, and the movement last continuously for a predetermined time span. The alarm activation occurs only if the ambient brightness falls below a predetermined darkness threshold and the movement continues to persist.

4 Claims, 5 Drawing Sheets

PROTECTION DEVICE

Figure 1:
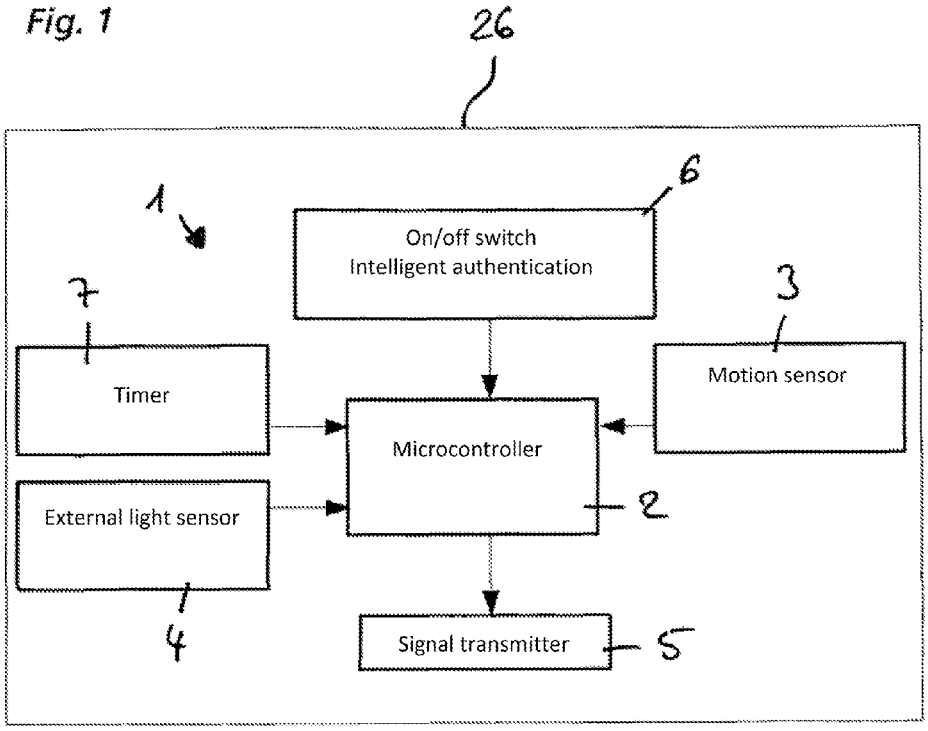

This is a National Phase Application filed under 35 U.S.C. 371 as a national stage of PCT/EP2012/000749, filed Feb. 21, 2012, and claiming the benefit from German Application No. 10 2011 012 163.3, filed Feb. 23, 2011, the content of each of which is hereby incorporated by reference.

The invention relates to a device for securing merchandise and objects, and to a method for operating such a device.

Every year, thefts in the retail industry results in losses in the range of billions of Euros, with approximately 40% of the total amount of loss resulting from theft by customers and approximately 30% resulting from theft by employees.

For that reason, there is increasing demand in the retail industry for technical merchandise protection systems that are capable of purposefully making the theft of merchandise by customers and also by employees more difficult or even preventing such theft. In particular, high-value or costly merchandise, such as perfume, cosmetic and personal care products, electronic devices, software, CDs and DVDs, etc., is potentially threatened by theft, since such products are frequently small and lightweight and can therefore be easily concealed.

In the retail industry, so-called electronic article surveillance (EAS) has become well established as a system for theft prevention, and can be implemented using several different technologies. Acousto-magnetic (AM), electromagnetic (EM) and radio frequency (RF) systems are used; these are sufficiently well-known and therefore will not be discussed in any further detail. Relatively novel in this field is RFID technology; however, this technology is still too costly for widespread use.

A number of other article protection systems are also in use, all of which are designed to prevent the theft of merchandise. In particular, systems exist which are equipped with an electronic alarm system comprising an alarm signal transmitter and a plurality of sensors for detecting alarm conditions. Although one such system can be universally adapted to various applications, alarm activation occasionally occurs even when no theft is actually being attempted. In other words, the percentage of false alarms can be quite high, thereby undermining the alarm, since over time it is no longer taken seriously.

The problem addressed by the invention is therefore that of devising a device for securing merchandise and objects that has the lowest possible percentage of false alarms.

This problem is solved according to the invention by an alarm device having the features of the main claim.

The electronic alarm system according to the invention has a time measurement device, with which the lapsing of a predefined time span can be monitored. The electronic alarm system further has at least one additional sensor, which is embodied not principally for detecting movement. The electronic alarm system in this case is embodied such that the additional sensor is activated by the detection of motion, such that an alarm is enabled when the sensor value from the additional sensor exceeds or drops below a predefined threshold value, and when movement is present continuously over a predefined span of time.

If the electronic alarm system has a plurality of additional sensors, all the additional sensors are first activated by motion. To enable an alarm and to activate the alarm, the threshold values for all sensors must also be exceeded and/or dropped below.

The invention is based upon the knowledge that in most cases of theft in shops and warehouses, the merchandise is removed from a bright environment, for example, a shelf, and is then concealed in a bag or under a jacket.

One preferred embodiment of the invention therefore has an ambient brightness sensor as an additional sensor.

Thus, the merchandise is first moved, as a result of which movement the motion sensor activates the brightness sensor when movement is detected. If there is not sufficient brightness during the movement, then it is nighttime, for example, and the shop has closed. The movement is therefore most likely accidental, and not caused by a person. In that case, no attempt at theft is present, and no alarm is enabled.

In this case, it is also important for the movement to occur continuously over a predetermined span of time. In this manner, an accidental movement, for example, merchandise falling over on a shelf, even in a bright environment, can be prevented from triggering an alarm. For this purpose, the device according to the invention is equipped with the time measurement device, embodied, for example, as a timer, which is started at a predetermined time. This timer can be implemented as discretely analog or digital or as a program of a microprocessor.

With these measures, the percentage of false alarms is substantially reduced, so that an alarm will excite the desired attention.

The alarm is preferably activated when, with prolonged movement, the ambient brightness level drops below a predefined darkness threshold. This corresponds to concealment inside a bag or under a jacket.

To activate the alarm, however, another or several different conditions may have to be met. For instance, it would be conceivable for the electronic alarm system to have a pressure sensor or another environmental sensor.

In a further advantageous embodiment of the invention, the additional sensor is a proximity sensor.

The proximity sensor is embodied, for example, as a capacitive proximity sensor. This sensor detects a field-based approach by and the presence of a human body part or metallized surfaces, such as manipulated metallized tote bags or articles of clothing, for example, in the vicinity of the tag. In this manner, it is possible to reliably detect any pocketing/concealment or shielding, regardless of the ambient brightness level, since in such cases the tag is always present very close to the human body, e.g., underneath a jacket or in manipulated, metallized tote bags or articles of clothing. The described manipulation of bags or articles of clothing using metal films, for example, is a highly preferred method for avoiding detection by article surveillance antennas (EAS).

A reflective sensor having an optical or acoustic operating mode, for example, can also be used as the proximity sensor. This sensor detects reflective material surfaces, such as articles of clothing, tote bags, or even skin, at a defined distance range (for example, <50 mm).

It is thereby possible to reliably detect any pocketing/concealment or shielding, regardless of the ambient brightness level, since in such cases the tag is always very close to any materials. The tag is the protection device (mechanical component) for attachment to the merchandise in which the electronic alarm system is arranged.

The proximity sensor can also be a body-borne sound sensor, for example. This sensor detects any body-borne sound near to the tag housing. Any pocketing/concealment or shielding by articles of clothing, tote bags or hands always generates a specific signal spectrum because the tag is then in contact with some type of material.

This allows any pocketing/concealment or shielding to be reliably detected, regardless of the ambient brightness level, since in such cases, the tag will come into contact with some type of material.

Furthermore, the alarm device can also have a plurality of these or even other sensors, in any functional combination.

It is particularly expedient to combine an ambient brightness sensor with a proximity sensor, so that reliable alarm detection can be ensured in nearly all theft scenarios, while at the same time ensuring a very low percentage of false alarms.

It is essential to the invention that the alarm is controlled in principle in two planes, and that an alarm must first be enabled in order for the alarm to be activated in a second step. For preventing false alarms, it is decisive that the conditions for enabling an alarm and for activating an alarm are different, and must persist over time.

For signaling an alarm, an optical and/or acoustic alarm signal transmitter can be provided. The protection device preferably has an acoustic signal transmitter, for example, a piezoelectric speaker.

The device expediently has an on/off switch, with which the electronic alarm system can be switched on or off. Preferably, the entire protection device is first switched on when it is fastened to an object to be protected. This prevents the device from unnecessarily consuming energy and from triggering alarms while the device lies unused in a warehouse box, for example. To prevent a deactivation of the alarm device on the object by unauthorized persons, it is advantageous for the on/off switch to require additional authentication. Such authentication can be provided, for example, by information transmitted in a contactless or contact-based manner. Said information can be transmitted, for example, through a type of key, which is held, for example, on the device.

In summary, the method for operating an electronic alarm system according to the invention can be described as follows by way of example for a brightness sensor.

The ambient brightness sensor is first activated when the motion sensor registers movement, and an alarm is first enabled when the brightness level measured by the ambient brightness sensor exceeds or drops below a predetermined brightness threshold, and the movement persists continuously for a predetermined time span.

An alarm is preferably activated only once the alarm has been enabled and when at least one additional alarm condition has been met.

In this case, it can be advantageous for the alarm activation to first trigger a pre-alarm for a brief span of time, during which the enabling of the alarm can be reset, and once the pre-alarm has ended, a persistent alarm is activated.

One example of an additional alarm condition is that the brightness measured by the ambient brightness sensor must drop below a predetermined darkness threshold while the movement persists continuously.

In what follows, the invention will be specified in greater detail in reference to the appended set of drawings.

Figure 2:
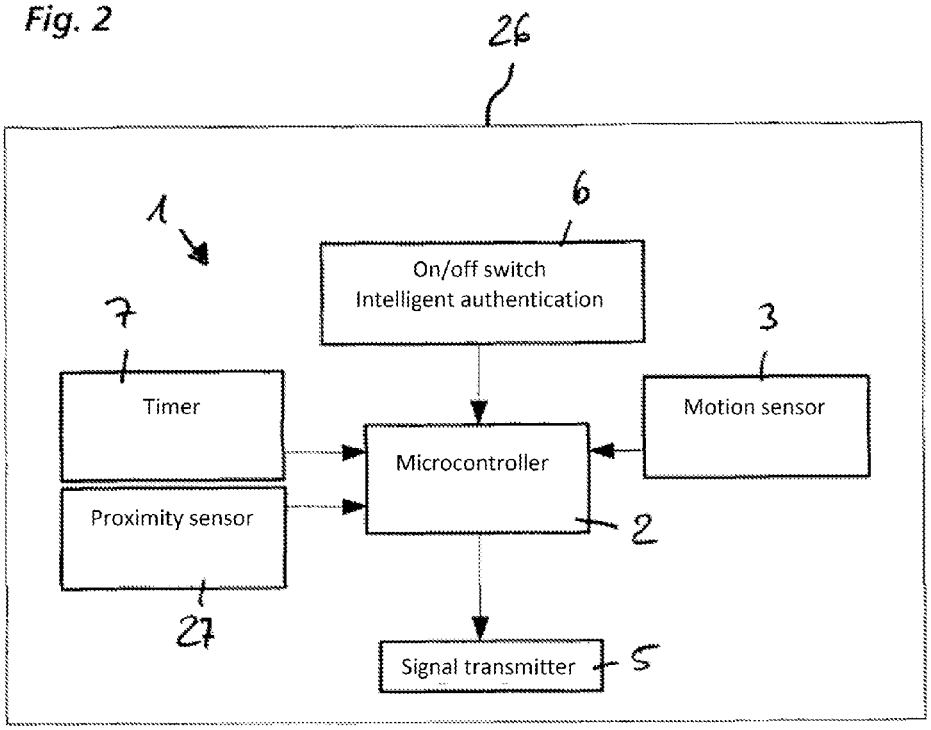
Figure 3:
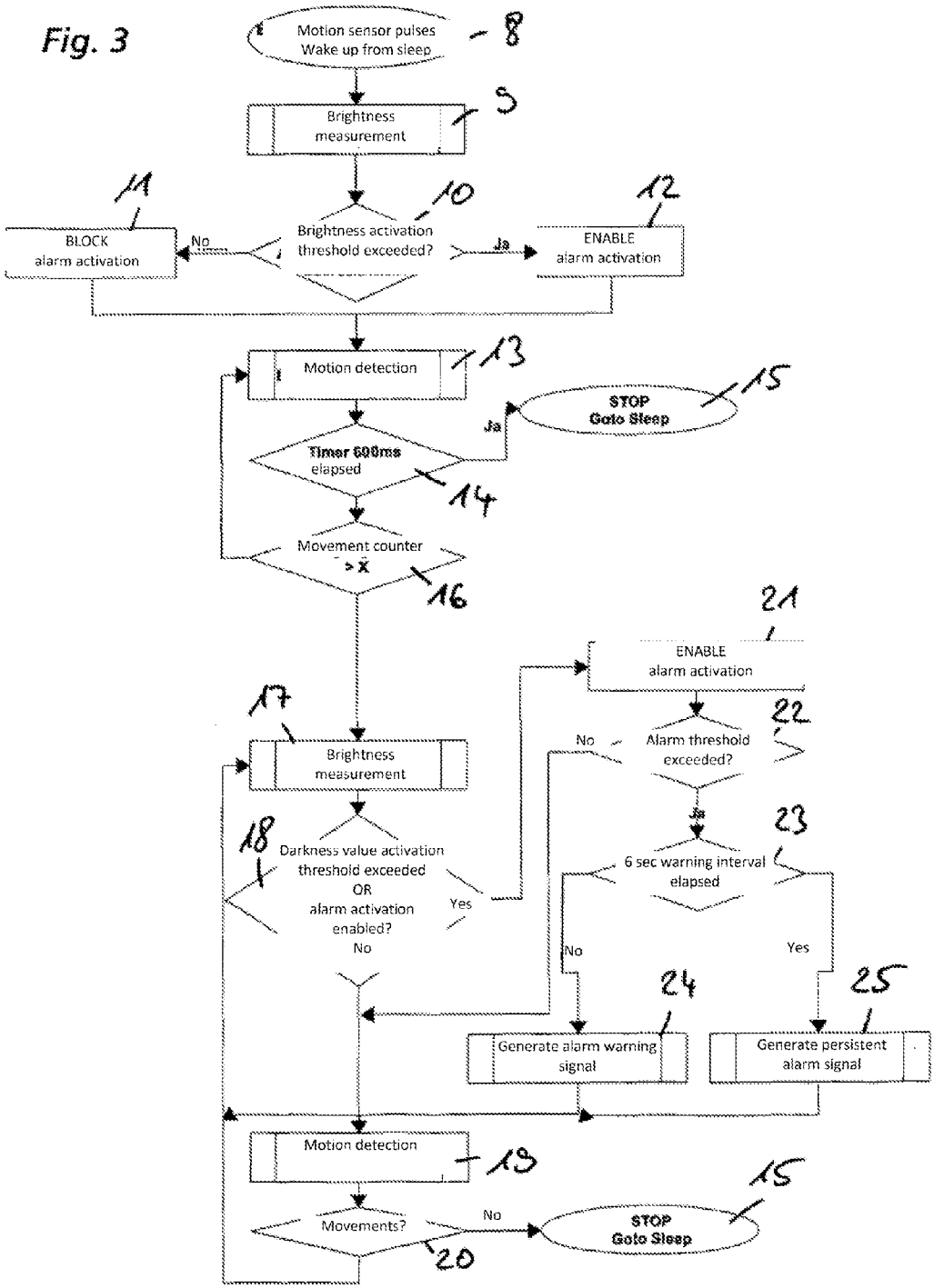
Figure 4:
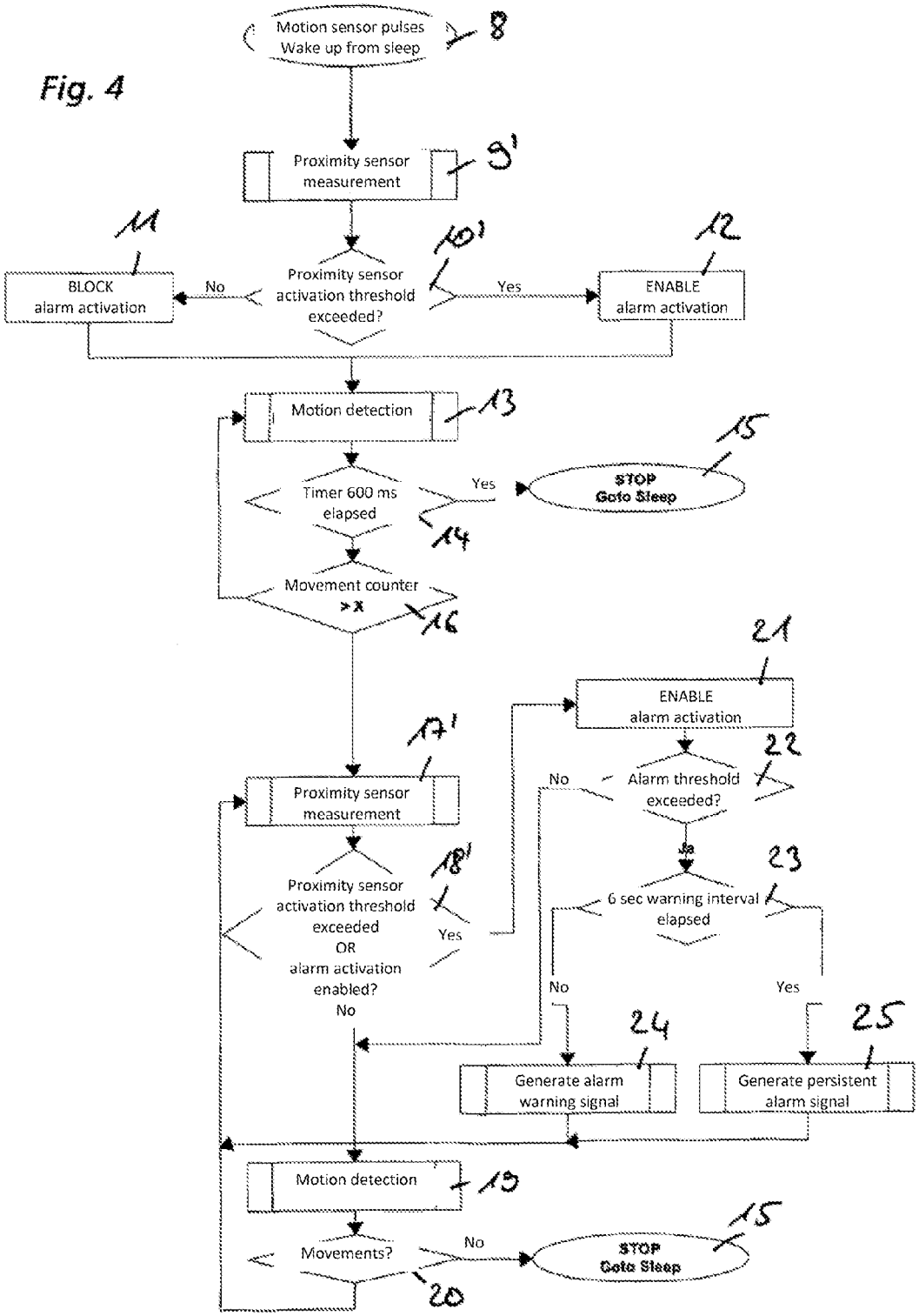
Figure 5:
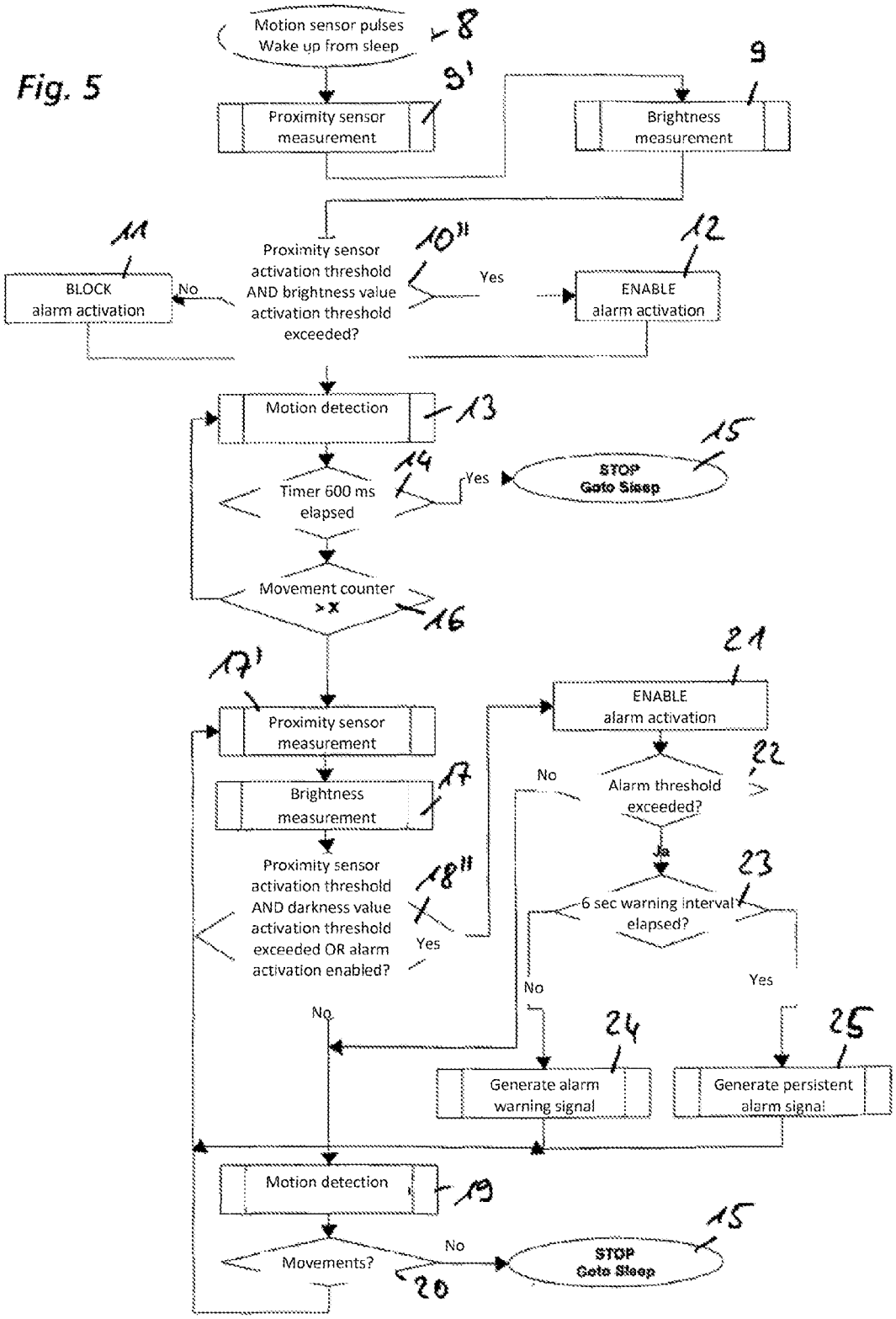

The drawings show:

FIG. 1 a block diagram illustrating a preferred embodiment of a protection device according to the invention having a brightness sensor, FIG. 2 a block diagram illustrating another embodiment of a protection device according to the invention having a proximity sensor, FIG. 3 a flow chart illustrating the alarm monitoring by a protection device according to the invention having a brightness sensor, FIG. 4 a flow chart illustrating the alarm monitoring by a protection device according to the invention having a proximity sensor and FIG. 5 a flow chart illustrating the alarm monitoring by a protection device according to the invention having a brightness sensor and a proximity sensor.

FIG. 1 shows a block diagram illustrating a preferred protection device 26 according to the invention. The illustrated embodiment comprises an electronic alarm system 1 with a microcontroller 2, a motion sensor 3, a brightness sensor 4, an alarm signal transmitter 5 and an off/off switch 6.

The microcontroller in the example is embodied as a central control unit, which controls all the other components by means of an operating program, and receives signals. Of course, the electronic alarm system 1 can also be constructed as discretely digital or analog without a central control unit, or can have other central control means. In particular, it is possible to integrate all components into one component or into one chip.

The electronic alarm system 1 is preferably arranged in a housing 26, which is preferably adapted to an object to be secured, and can preferably be detachably fastened thereto, so that the protection device 26 can be reused multiple times. The shape and configuration of the housing are not relevant to the invention, and therefore, these will not be discussed in greater detail here.

The protection device 26 is intended to trigger an alarm only when it is attached to an object to be protected. The electronic alarm system 1 is therefore equipped with an on/off switch 5. This on/off switch 5 is preferably provided with an intelligent authentication means, so that the electronic alarm system 1 can be switched on and off only by authorized persons. For this purpose, the electronic alarm system 1 has an interface, for example, via which authentication data can be received. This interface can be embodied as wired or as wireless.

The electronic alarm system 1 is expediently automatically switched on only after the protection device has been mounted on the object. When the protection device 26 is removed, for example, at the cash register, authentication is also required in order to switch the electronic alarm system off again.

The microcontroller 2 also controls the alarm signal transmitter 5, which is provided for indicating an alarm. The signal transmitter 5 preferably has a speaker, for example, a piezoelectric speaker. However, it can also additionally or alternatively have an optical signal transmitter and/or other alarm signal means. Thus an alarm could also be transmitted via radio to a mobile or stationary alarm receiver, for example.

The motion sensor 3 is embodied for detecting movement of a protection device 26. The precise configuration of the motion sensor plays only a subordinate role here, in that it must be sufficiently sensitive for the intended application. Nearly any known sensors can be used as motion sensors, for example, from motion sensors comprising a movably mounted metal ball to semiconductor acceleration sensors.

The type of ambient light sensor 4 used is also of marginal importance to the invention. For example, it can comprise a simple photodiode, a phototransistor or some other light-sensitive component. What is essential is that it must be capable of distinguishing between a plurality of ambient brightness values.

The protection device further has its own power supply, embodied, for example, as a battery (not shown).

With the protection device according to the invention, it is assumed that in most theft cases, merchandise is unlawfully concealed in a bag or under a jacket and carried out of the shop. This means that first the merchandise will be moved, and then a change in brightness level from bright to dark will occur.

Accordingly, the electronic alarm system 1 is embodied such that the electronic alarm system 1 has a standby mode, in which essentially only the motion sensor 3 and those parts of the circuit that are required for evaluating the motion sensor are supplied with current. A long battery lifespan is thereby enabled.

According to the invention, the electronic alarm system 1 has a time measurement device 7, with which the lapsing of a predetermine time span can be monitored. The electronic alarm system 1 is further embodied such that the ambient brightness sensor 4 is activated by a detection of movement, and such that an alarm is enabled when the ambient brightness level exceeds a predefined brightness threshold and when a continuous movement is present over a predefined time interval.

An alarm is activated, for example, when the ambient brightness level drops below a predetermined darkness threshold with prolonged movement.

FIG. 2 shows a block diagram of an alternative electronic alarm system having a proximity sensor in place of the brightness sensor. The proximity sensor 27 can be a capacitive proximity sensor, a reflection scanner, or a body-borne noise sensor, for example.

Of course, the electronic alarm system can also have a brightness sensor 4 and a proximity sensor 27. The electronic alarm system can also have other and/or additional sensors.

FIG. 3 shows a flow chart, by way of example, illustrating the way in which the electronic alarm system can be operated. This flow chart can be implemented discretely as an analog or digital circuit. Preferably, however, it is implemented as the operating program for a microprocessor or microcontroller, as in the example shown.

The electronic alarm system or the control unit is ordinarily in sleep mode 8 (energy saving mode), in which the electronic system requires very little energy.

Only when motion is registered by the motion sensor are the remaining electronics and the additional sensor activated. In the embodiment example shown, the additional sensor is a brightness sensor. As a result, the ambient brightness is first measured 9 and is then compared with a predefined threshold value 10. If the measured value is below the brightness threshold, in other words, if the surrounding area is darker 11, an alarm situation mostly likely does not exist and the electronic system will not enable an alarm. This prevents the triggering of an alarm when, for example, at night (in the dark) motion is registered, caused by passing trains or vehicles or other events, for example. If the surrounding area is dark in such cases, an alarm will not be enabled.

However, if the surrounding area is bright 12, in other words, if the store has opened and is illuminated, for example, alarm activation will be enabled (alarm enabling). However, in this case, there still is no alarm. For actual alarm activation, additional conditions must also be met, which are then verified as the process proceeds.

First, the registered movement must persist continuously over a certain span of time 13. In the example, a time interval of 600 ms is indicated 14, which is monitored by the time measurement device. If during this time interval no continuous movement is detected, then the initial movement was merely accidental and the electronic alarm system will return to sleep mode 15 without triggering an alarm.

If the movement persists, then a counter will count how often the time of the threshold value lapses, allowing a conclusion to be drawn regarding the total duration of the movement. If the counter exceeds a set limit×16, the system will proceed with alarm status verification. This prevents the activation of an alarm, for example, if, for example, an object is removed from a shelf for a short time and then put back immediately. In that case, the movement will end before the time interval has elapsed.

According to the above-mentioned theft scenario, the object would next be concealed in a bag or under a jacket. Accordingly, the brightness sensor will then determine 17 whether the area surrounding it becomes dark or darker 18. In this connection, an absolute darkness threshold can be predefined, or a relative threshold can be established which takes only the degree of change in lighting into consideration. As long as there is no change in brightness toward darkness, the motion sensor will continue to monitor motion in a loop 19. When the movement ends in a bright environment 20, the object has probably been put down while still in the shop, and the alarm monitoring will end by shifting the electronic alarm system to the sleep mode 15.

However, if the lighting drops below the darkness threshold, the alarm will be activated 21. In the example shown, a pre-alarm is then generated 24, which is intended to give the customer the opportunity to produce a state in which no alarm will be triggered. This can be the case, for example, if the area around a protected object is inadvertently darkened, for example, by other merchandise in a shopping cart or basket. During the pre-alarm, the loop is continuously executed for brightness and motion measurement. When the pre-alarm is activated and/or when the lighting drops below the darkness threshold, the pre-alarm will continue to be implemented until the pre-alarm time, in the example, 6 seconds, has elapsed 23. This pre-alarm time can also be monitored by the time measurement device.

If, after this pre-alarm time, all the conditions for an alarm continue to be present 22, in other words, motion and darkness, then the actual alarm 25 will be triggered, which can no longer be shut off by reestablishing the ambient brightness level. Authentication is preferably required to deactivate the alarm. This can be similar or identical to the on/off switch authentication.

Of course, the details of the alarm monitoring procedure can also be different. In particular, a pre-alarm can be dispensed with. Or the brightness and darkness thresholds can be different or adaptive. The invention therefore is not limited to the embodiment shown and the procedure shown.

FIG. 4 shows a flow chart illustrating an electronic alarm system according to the invention, with a proximity sensor 27 in place of the brightness sensor. The procedure in this case is practically identical to that of FIG. 3. In place of the brightness value, a corresponding proximity value is provided, which is accordingly queried and evaluated in the modified process steps 9', 10', 17' and 18'.

It is particularly advantageous for the electronic alarm system according to the invention to have a brightness sensor 4 and a proximity sensor 27. FIG. 5 shows a flow chart illustrating an electronic alarm system of this type.

To enable the alarm and to activate the alarm, in process steps 10" and 18" the sensor values from the brightness sensor 4 and the proximity sensor 27 are evaluated, respectively. Only if the sensor values of both sensors have exceeded or dropped below the respective activation threshold values is an alarm triggered or activated.

The combination of brightness sensor and proximity sensor covers the most common theft scenarios at relatively low cost. A theft can thereby be reliably detected and the percentage of false alarms can be kept very low.

In addition to the sensors shown here, the device according to the invention can have other or additional sensors, and therefore, the invention is in no way limited to the examples shown.

The invention claimed is:

1. A device for securing objects and/or merchandise against unauthorized removal, including an electronic alarm system (1), the electronic alarm system comprising:

a microcontroller(2)

an alarm signal transmitter (5); and a motion sensor (3), wherein motion detected by the motion sensor is determined to be either (i) temporary or (ii) continuous movement;

a time measurement device (7), with which the course of a predefined time span is monitored;

at least one additional sensor, which is embodied primarily not for detecting motion; and a counter;

wherein, the additional sensor is activated by the detection of the continuous movement, the microcontroller (2) enables an alarm activation when the sensor value of the additional sensor exceeds or drops below a predefined threshold value and when the continuous movement is present over a predefined time span, the alarm signal transmitter (5) produces an audible alarm including a pre-alarm or a persistent alarm, the audible alarm only occurs when the alarm activation has been enabled and at least one additional alarm condition has been met, the alarm activation first triggers the pre-alarm for a predetermined period of time which can be deactivated by eliminating the at least one additional alarm condition, and then triggers the persistent alarm which requires a user authentication to deactivate if the at least one additional alarm condition is not reestablished before the predetermined period of time elapses.

2. The device according to claim 1, wherein the additional sensor is an ambient brightness sensor (4) and in that the alarm is activated when, with the continuous movement, the ambient brightness level drops below a predefined darkness threshold.

3. A method for operating an electronic alarm system comprising:

a motion sensor, wherein motion detected by the motion sensor is determined to be either (i) temporary or (ii) continuous movement;

a microcontroller (2);

a counter that counts how often a predetermined time interval lapses;

an additional sensor; and an alarm signal transmitter (5);

wherein the additional sensor is activated only once the motion sensor registers movement, and the microcontroller (2) enables an alarm activation only when the sensor value measured by the additional sensor exceeds or drops below a predefined threshold value and the movement persists continuously over a predefined time interval, the alarm signal transmitter (5) produces an audible alarm including a pre-alarm or a persistent alarm, the audible alarm only occurs when the alarm activation has been enabled and at least one additional alarm condition has been met, the alarm activation first triggers the pre-alarm for a predetermined period of time which can be deactivated by eliminating the at least one additional alarm condition, and then triggers the persistent alarm if the at least one additional alarm condition is not reestablished before the predetermined period of time elapses.

4. The method according to claim 3, wherein the persistent alarm requires a user authentication to deactivate.

* * * * *